US005989159A

United States Patent [19]

Chen et al.

[11] Patent Number: 5,989,159

[45] Date of Patent: Nov. 23, 1999

[54] EXERCISE DEVICE

[76] Inventors: James Chen, No. 35, Tun Hi Rd., Chin Chan Li, Sa Lu, Taichung; Hui-Nan Yu, No. 14, Lane 252, Chien Kuo Road, Tao Yuan, both of Taiwan

[21] Appl. No.: 09/010,573

[22] Filed: Jan. 22, 1998

[51] Int. Cl.[6] ..... A63B 69/16; A63B 22/04

[52] U.S. Cl. ..... 482/52; 482/51; 482/70

[58] Field of Search ..... 482/51, 52, 53, 482/57, 70, 79, 80, 62

[56] References Cited

U.S. PATENT DOCUMENTS

| | | | |
|---|---|---|---|
| 5,242,343 | 9/1993 | Miller | 482/51 |
| 5,299,993 | 4/1994 | Habing | 482/52 |
| 5,383,829 | 1/1995 | Miller | 482/57 |
| 5,518,473 | 5/1996 | Miller | 482/57 |
| 5,562,574 | 10/1996 | Miller | 482/52 |
| 5,593,372 | 1/1997 | Rodgers | 482/52 |

*Primary Examiner*—Stephen R. Crow
*Attorney, Agent, or Firm*—Browdy and Neimark

[57] ABSTRACT

An exercise device capable of animating a walking motion is composed of a frame on which a damping unit, two drive units, and a handle are mounted. The drive units are respectively composed of a first frame, a second frame, a connection frame connecting the first frame and the second frame, a slide rod connecting the second frame and a crank of the damping unit, and a pedal rod fastened pivotally at one end thereof with the connection frame and at another end thereof with a roller capable of sliding on the slide rod. The drive units are driven at the same time in opposite directions when the pedal rods are at work, thereby resulting in the actuation of a rotary wheel for bringing about a leg exercise.

9 Claims, 5 Drawing Sheets

EXERCISE DEVICE

FIELD OF THE INVENTION

The present invention relates generally to an exercise device, and more particularly to an exercise device of a compact size for building leg muscles.

BACKGROUND OF THE INVENTION

There are a variety of exercise devices currently available in the market place. These exercise devices are intended for use in building the muscles of various parts of a human body. A relatively new and good stationary exercise device is disclosed in the U.S. Pat. No. 5,383,829. Such a prior art stationary exercise device is effective in building the leg muscles; nevertheless it is rather cumbersome.

SUMMARY OF THE INVENTION

The primary objective of the present invention is to provide a compact device for exercising legs of a person.

In keeping with the principle of the present invention, the foregoing objective of the present invention is attained by the exercise device consisting of a frame on which a damping unit, two drive units and a handle are mounted. The drive units are respectively composed of a first frame, a second frame, a connection frame connected with the first frame and the second frame, a slide rod connecting the second frame and a crank of the damping unit, and a pedal rod fastened pivotally at one end thereof with the connection frame and at another end thereof with a roller. The two drive units are driven at the same time in opposite directions when the pedal rods are at work, thereby resulting in the actuation of a rotary wheel by the crank. The exerciser is thus capable of doing a leg exercise.

The features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
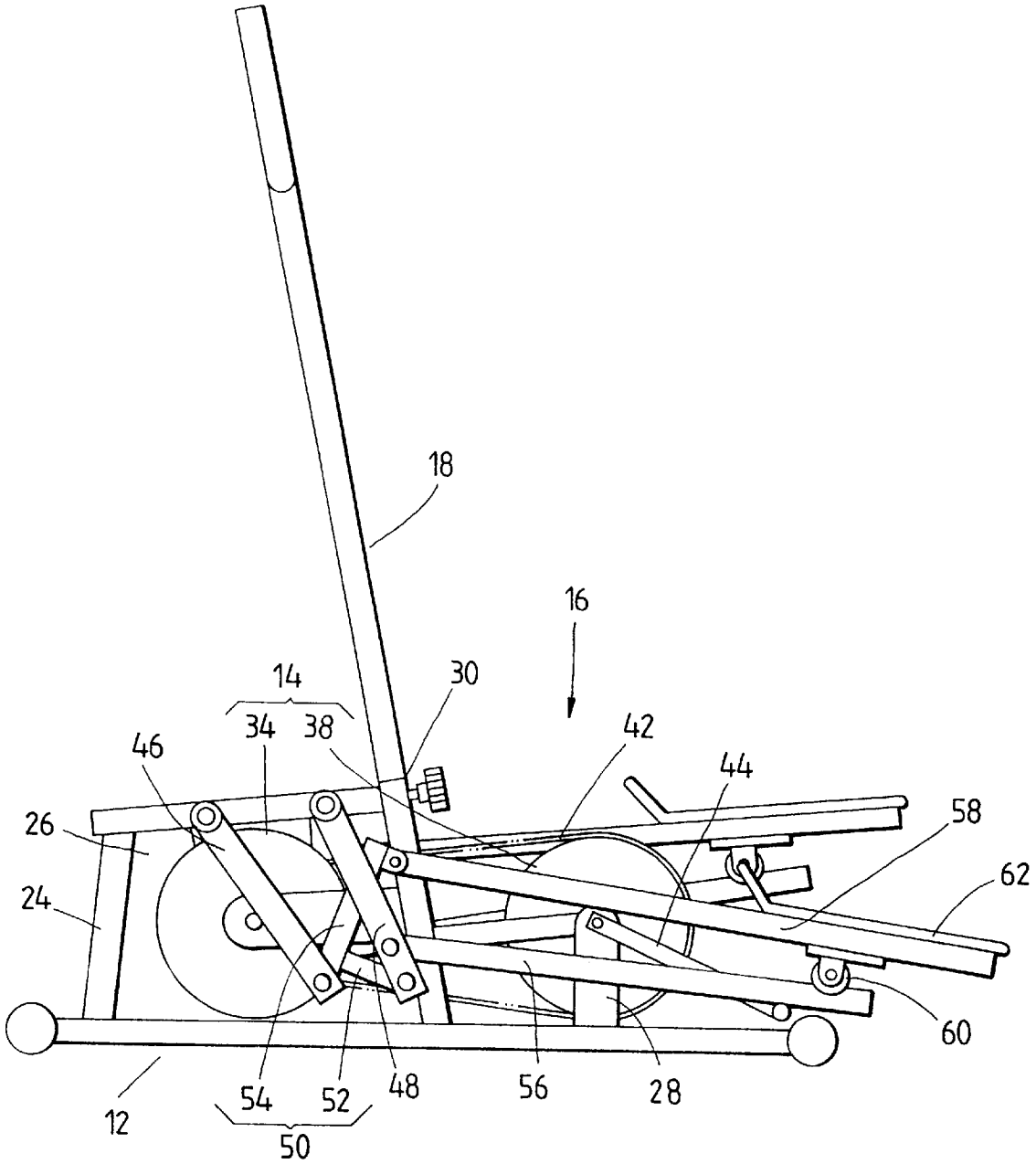
FIG. 1 shows a front view of the preferred embodiment of the present invention.
Figure 2:
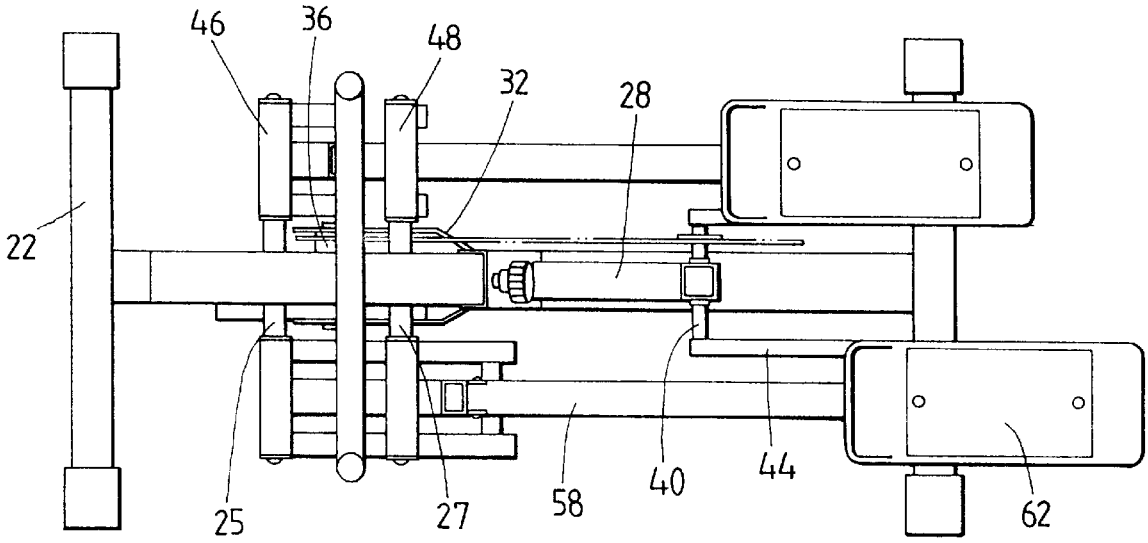
FIG. 2 shows a top view of the preferred embodiment of the present invention.
Figure 3:
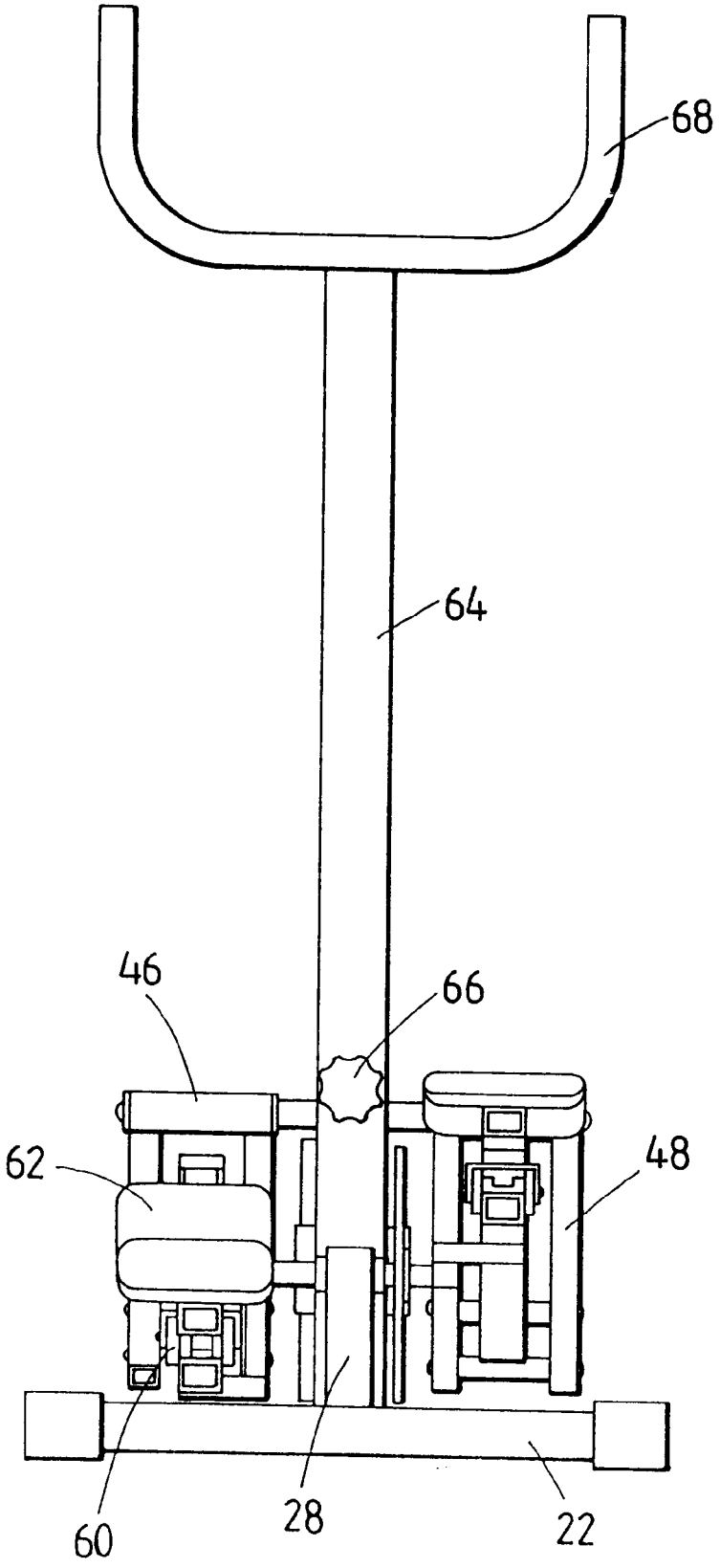
FIG. 3 shows a side view of the preferred embodiment of the present invention.

As shown in FIGS. 1–3, an exercise device 10 embodied in the present invention is composed of a frame 12, a damping unit 14, two drive units 16, and a handle 18.

The frame 12 has an H-shaped base 22 on which a support frame 24, an upright frame 28 and two clamping members 32 are mounted such that the support frame 24 is located at one end of the base 22, and that a receiving space 26 is located between the base 22 and the support frame 24, and further that the upright frame 28 is located at another end of the base 22 and is connected with the support frame 24 which is provided at one end thereof with a cell 30. The clamping members 32 are fastened respectively at one end thereof with the support frame 24.

The damping unit 14 is composed of a damping member 34 which is mounted on a pivot 36 such that the damping member 34 is located between the free ends of the two clamping members 32, and that the damping member 34 is located in the receiving space 26. The pivot 36 is provided along the edge of one end thereof with teeth (not shown in the drawings). A rotary wheel (sprocket wheel) 38 is fastened pivotally with the upright frame 28 by means of a pivoting rod 40 such that the rotary wheel 38 is linked with a pivot 36 by a linking member (chain) 42. Two cranks 44 are fastened with the pivoting rod 40.

The drive units 16 are mounted on the frame 12 such that the two drive units 16 are opposite in location to each other. Each of the two drive units 16 is composed of a first frame 46, a second frame 48, a connection frame 50, a slide rod 56, and a pedal rod 58.

The first frame 46 of a rectangular construction is fastened at the top end thereof with one end of a pivot 25 which is mounted on the support frame 24.

The second frame 48 of a rectangular construction is fastened at the top end thereof with one end of a pivot 27 which is mounted on the support frame 24. The distance between the top ends of the second frame 48 and the first frame 46 is greater than the distance between the bottom ends of the second frame 48 and the first frame 46.

The connection frame 50 of an L-shaped construction has a connection section 52 and an upright section 54. The connection section 52 is fastened pivotally between the first frame 46 and the second frame 48. The upright section 54 is extended uprightly from one end of the connection section 52.

The slide rod 56 is fastened pivotally at one end thereof with the second frame 48 such that the slide rod 56 is separated from the connection section 52 by an appropriate distance, and that the slide rod 56 is fastened at another end thereof with the crank 44.

The pedal rod 58 is fastened pivotally at one end thereof with the upright section 54, and at another end thereof with a roller 60 capable of moving on the slide rod 56. The pedal rod 58 is provided with a pedal 62 fastened thereto.

The handle 18 has a support rod 64 which is fastened in the cell 30 by a rotary button 66. A hand grip 68 of a U-shaped construction is fastened with the support rod 64.

Figure 4:
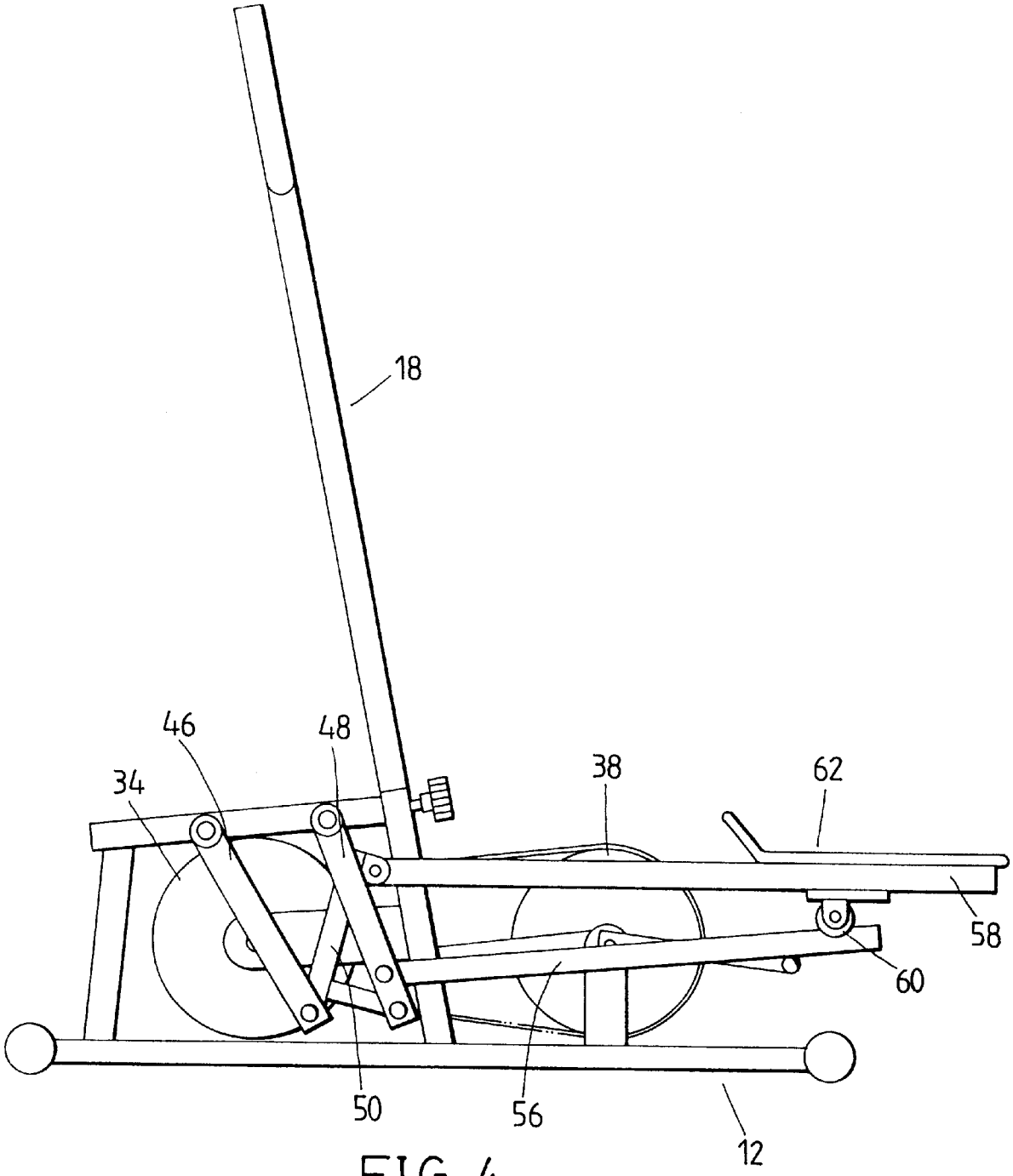
FIG. 4 shows a schematic view of the preferred embodiment of the present invention at work.
Figure 5:
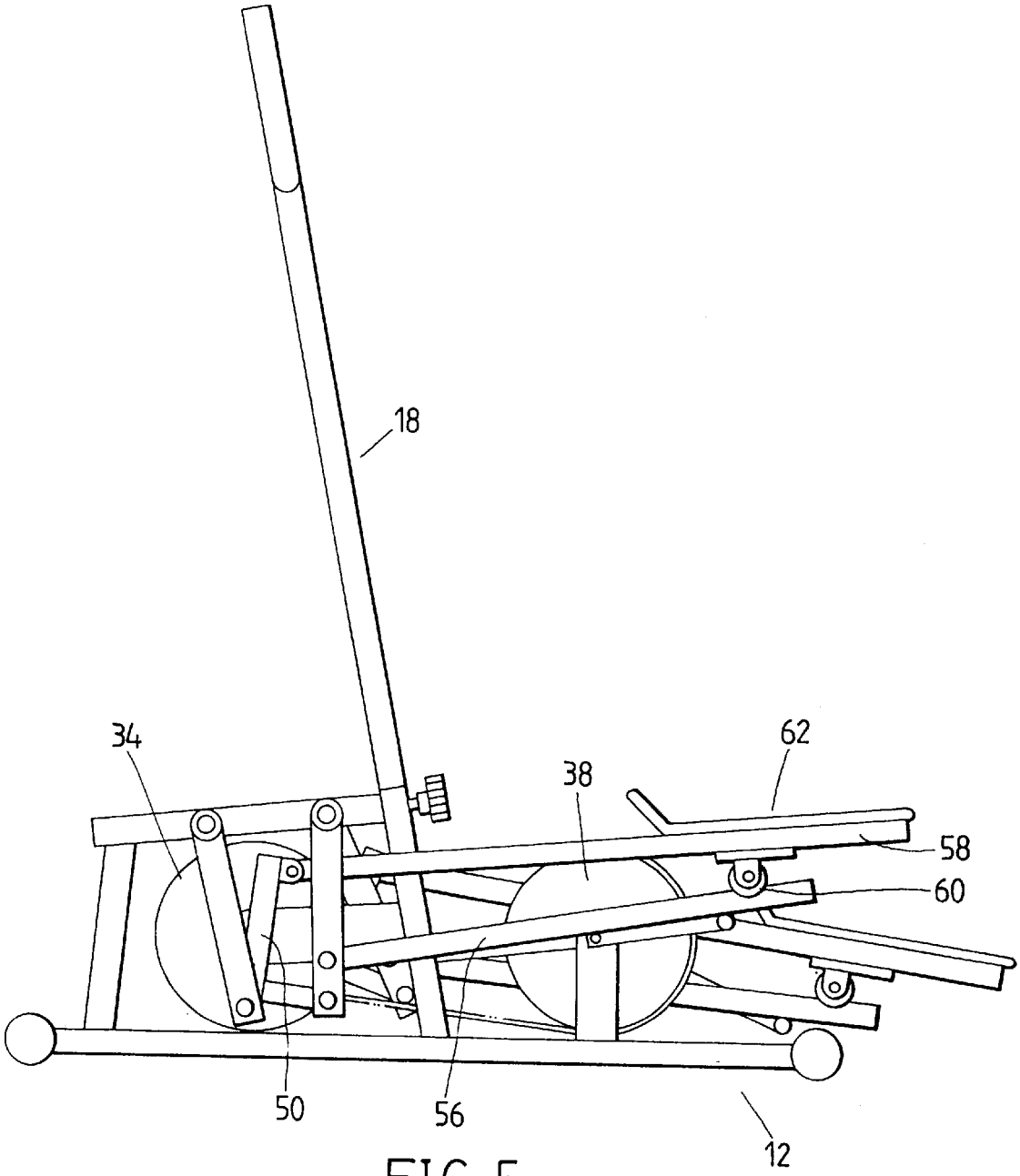
FIG. 5 shows another schematic view of the preferred embodiment of the present invention at work.

In operation, the crank 44 is actuated to turn counterclockwise when the pedal 62 located at the higher level is exerted on by an external force. As a result, the rotary wheel 38 is caused to turn counterclockwise such that the damping member 34 is actuated. In the meantime, the slide rod 56 is actuated to displace in the direction toward the front end of the base 22, thereby causing the first frame 46 and the second frame 48 to swing toward the front end of the base 22. In the meantime, the crank 44, the first frame 46 and the second frame 48 of another set swing in the opposite direction such that the left pedal 62 is lifted to locate at a level higher than the level at which the right pedal 62 is located, as illustrated in FIGS. 4 and 5. The leg exercise is thus brought about by the motions of the two drive units 16. In view of the two rollers capable of sliding on the slide rods for a distance corresponding to the swinging radian of the end of the upright section of the connection frame, the leg exercise brought about by the present invention is close to the ordinary walking manner.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exercise device comprising:

a frame having a base, a support frame mounted on the base, and a receiving space defined by said base and said support frame;

a damping unit consisting of a damping member fastened pivotally in said receiving space, a rotary wheel rotatably mounted on said base, a linking member connecting said rotary wheel and said damping member, and two cranks fastened with said rotary wheel;

two drive units fastened pivotally with said frame for driving said cranks to actuate said rotary wheel and said damping member for bringing about a leg exercise; and a handle mounted on said frame;

wherein each of said two drive units comprises:

a first frame fastened pivotally with said frame;

a second frame fastened pivotally with said frame such that said second frame is spaced from said first frame;

a connection frame fastened between said first frame and said second frame;

a slide rod connecting said second frame and said cranks; and a pedal rod fastened pivotally at one end thereof with said connection frame, and at another end thereof with a roller capable of sliding on said slide rod.

2. The exercise device as defined in claim 1, wherein said first frame and said second frame of each of said two drive units are separated such that top ends of said first frame and said second frame are separated by a distance greater than a distance between bottom ends of said first frame and said second frame.

3. The exercise device as defined in claim 1, wherein said pedal rod is provided with a pedal fastened thereto.

4. The exercise device as defined in claim 1, wherein said frame further comprises an upright frame opposite to said support frame.

5. The exercise device as defined in claim 4, wherein said upright frame is provided with a pivoting rod fastened thereto; and wherein said rotary wheel is mounted on one end of said pivoting rod.

6. The exercise device as defined in claim 1, wherein said frame further comprises two clamping members fastened with said support frame such that said damping member is fastened pivotally between said two clamping members.

7. The exercise device as defined in claim 6, wherein said damping member is rotatably mounted on a pivot fastened between said two clamping members.

8. The exercise device as defined in claim 7, wherein said rotary wheel is a sprocket wheel; and wherein said linking member is a chain linking said rotary wheel and said pivot for driving said damping member.

9. The exercise device as defined in claim 1, wherein said connection frame has a connection section and an upright section extending from one end of said connection section; and wherein said pedal rod is fastened with a free end of said upright section of said connection frame.

* * * * *